US005465199A

United States Patent [19]

Bray et al.

[11] Patent Number: 5,465,199

[45] Date of Patent: Nov. 7, 1995

[54] SYSTEM FOR ATTACHING TRIM TO LAMP HOUSING

[75] Inventors: Douglas R. Bray, Medford, N.J.; Michael M. Strazhnik, Philadelphia, Pa.

[73] Assignee: Sea Gull Lighting, Riverside, N.J.

[21] Appl. No.: 292,995

[22] Filed: Aug. 19, 1994

[51] Int. Cl.[6] ..... F21S 1/02

[52] U.S. Cl. ..... 362/364; 362/147; 362/365; 362/374

[58] Field of Search ..... 362/148, 364, 362/365, 455, 147, 150, 396, 368, 226, 374, 375

[56] References Cited

U.S. PATENT DOCUMENTS

| | | | |
|---|---|---|---|
| 4,475,147 | 10/1984 | Kristofek | 362/148 |
| 4,703,406 | 10/1987 | Elliott et al. | 362/365 |
| 4,754,377 | 6/1988 | Wenman | 362/148 |
| 4,763,231 | 8/1988 | Houplain | 362/148 |
| 4,829,410 | 5/1989 | Patel | 362/147 |
| 5,045,984 | 9/1991 | Trowbridge et al. | 362/365 |
| 5,130,914 | 7/1992 | Bengochea | 362/364 |
| 5,309,342 | 5/1994 | Heinen, Sr. | 362/365 X |

OTHER PUBLICATIONS

Magic Halogen fitted spotlight, Hettich America L.P., Charlotte, N.C., date unknown.

PUKLIGHT® halogen low voltage mini–downlight, Lucifer Lighting Company, San Antonio, Tex., product specification, 1991.

Rise Lighting Co., Ltd., Taipei, Taiwan, product sample No. DL–666, date unknown.

Decor–Ring, HERA Lighting Inc., Tucker, Ga., date unknown.

*Primary Examiner*—Ira S. Lazarus

*Assistant Examiner*—Thomas M. Sember

*Attorney, Agent, or Firm*—Seidel Gonda Lavorgna & Monaco

[57] ABSTRACT

Lighting trim attaches to lamp housing by mating one or more trim attachment regions with respective housing attachment regions. Each trim attachment region includes a finger thereon. The finger ends in a downwardly curved lip. Each housing attachment region includes a slot and a detent sector adjacent to and in communication with the slot. The trim's finger and the housing's slot are dimensioned so that the finger can pass through the housing slot when they are aligned with each other. The finger's lip becomes seated into the housing detent sector upon subsequent rotation of the trim with respect to the housing.

19 Claims, 4 Drawing Sheets

SYSTEM FOR ATTACHING TRIM TO LAMP HOUSING

FIELD OF THE INVENTION

This invention relates to luminaires and lighting fixtures, and more particularly to a system for attaching a trim piece to lamp housing in a recessed fixture.

BACKGROUND OF THE INVENTION

Systems for attaching a lamp housing to a trim piece in recessed fixtures are known in the art. In one prior art attachment scheme, torsion leaf springs or wire hangers are attached to peripheral sides of a lamp housing in a manner that allows them to slideably move in a vertical direction. A trim assembly is attached or clipped onto one end of the hangers. Then, the trim piece and the attached hangers are pushed into the lamp housing. The hangers become recessed into the lamp housing. Removal of the trim piece from the housing is accomplished by reversing this procedure. One example of this scheme is shown in U.S. Pat. No. 4,754,377.

U.S. Pat. No. 4,829,410 discloses a scheme to secure a support ring to the lens of a lamp. The lamp support ring includes a pair of bayonet tabs which are movable in corresponding lamp slots.

Other prior art schemes for attaching trim to a lamp housing employ screws, tabs, clips and the like.

There is still a need for a trim attachment scheme which does not require additional parts or tools to join trim to housing, which allows the trim to quickly connect to and disconnect from the housing, which allows the attachment parts to be hidden from view, and which can be employed with a variety of different trim designs. The present invention fills that need.

SUMMARY OF THE INVENTION

The present invention provides a trim attachment system for a recessed lighting unit which includes a lamp housing having a generally cylindrical portion and a trim piece having a generally cylindrical portion for attachment thereto. The system comprises at least one first attachment region associated with a first circumferential region on a selected one of the support or trim piece and at least one second attachment region associated with a second circumferential region on the other of the support or trim piece for mating with the first attachment region. The first attachment region includes a slot extending along the first circumferential region and having a first length. The first attachment region also includes a detent sector adjacent to and in communication with the slot and also extending along the first circumferential region. The second attachment region includes a finger thereon. The finger has a second length smaller than the first length so as to allow the finger to pass through the slot. The finger has a proximal end connected to the selected one of the support or trim piece and a distal end. The finger has a lip at its distal end for seating into the detent sector when the finger is passed through the slot and the trim piece is rotated relative to the housing.

In another embodiment, the invention provides a trim attachment system for a recessed lighting unit comprising a lamp housing for attachment to a structural support and a trim piece for attachment to the housing. The lamp housing has a generally cylindrical portion and a plurality of first attachment regions spaced along the circumference of its cylindrical portion. Each of the first attachment regions include a slot and a detent sector. The slot extends along the circumference and has a first length. The detent sector is adjacent to and in communication with the slot. The detent sector also extends along the circumference. The trim piece has an upper circumferential region which includes a plurality of second attachment regions. Each of the second attachment regions are associated with a respective one of the first attachment regions. Each of the second attachment regions include a finger and a lip. The finger extends from the upper circumferential region and generally follows the contour of the upper circumferential region. The finger has a second length smaller than the first length so as to allow the finger to pass through the slot. The finger has a proximal end and a distal end. The proximal end is connected to the trim piece. The lip is disposed at the distal end of the finger. The lip seats into the detent sector when the finger is passed through the slot and the trim piece is rotated relative to the housing.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE PREFERRED EMBODIMENT

Figure 1:
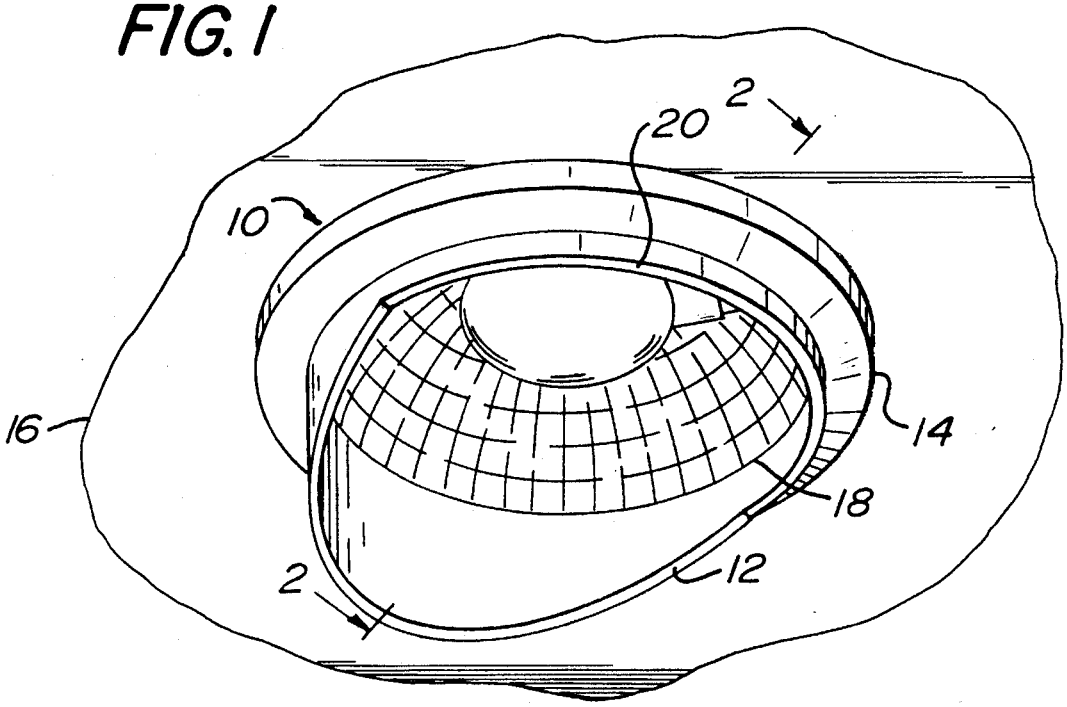
FIG. 1 is a perspective view of one preferred form of a recess mounted lighting fixture which employs the trim attachment scheme in accordance with the present invention, shown with a trim piece fully attached to a recess mounted lamp housing.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Apparatus depicting the preferred embodiment of the novel attachment system is illustrated in the drawings.

Figure 2:
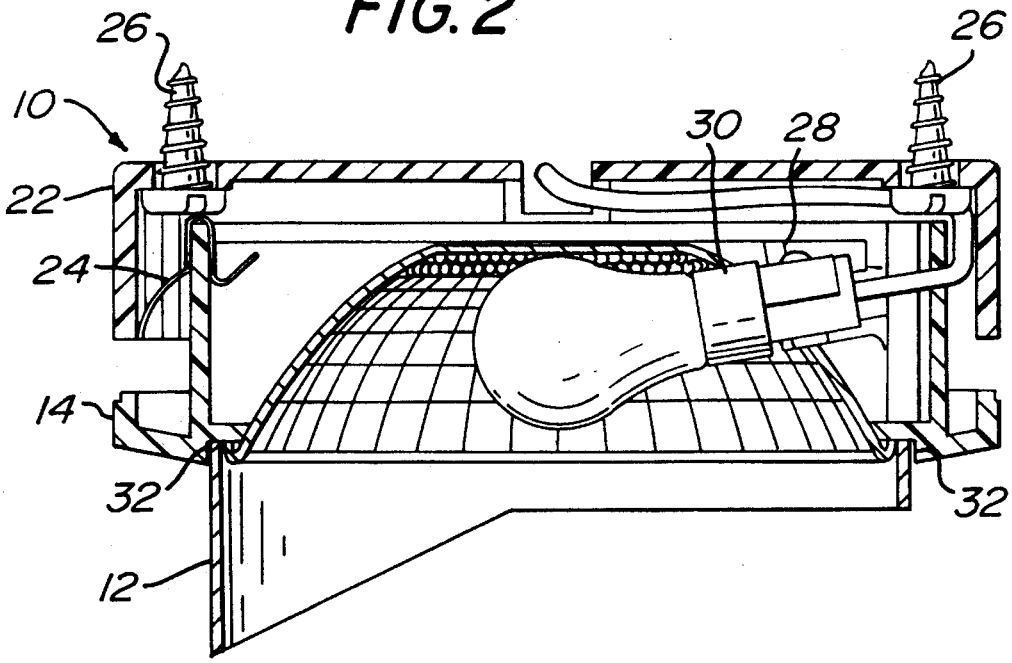
FIG. 2 is a sectional side view of an installed recess mounted lighting fixture of FIG. 1, taken along line 2—2 in FIG. 1.

Turning first to FIG. 1, a fully assembled lighting fixture 10 is shown having a trim 12 attached to a housing 14. The trim 12 has a generally cylindrical upper region and the housing has a generally cylindrical lower region. The trim 12 is recess mounted to the housing 14. The housing 14 is held in place against wall or ceiling 16 for example, by attaching it to a junction box, as best shown in FIG. 2. Other methods of attaching the housing 14 to a wall, ceiling or other surface may be used without departing from the invention. FIG. 1 also shows optional reflector 18 which is built into the housing 14. Alternatively, the reflector 18 could be part of the trim 12. Light bulb 20 is attached to the housing 14 as shown in FIG. 2. The trim 12 is shown for illustrative purposes as a decorative eyelid design. However, the trim attachment scheme described herein is usable with any type of decorative trim design.

FIG. 2 shows a sectional view of an installed recessed lighting fixture 10, taken along line 2—2 in FIG. 1. The housing 14 is mounted to junction box 22 through clips 24 (one clip is shown in this view). The junction box 22 is secured to a ceiling or to wall joists through fastening screws 26. Mounting bracket 28 attaches bulb socket 30 to the housing 14. Eyelid trim 12 is partially recessed into shoulder 32 of the housing 14.

Figure 3:
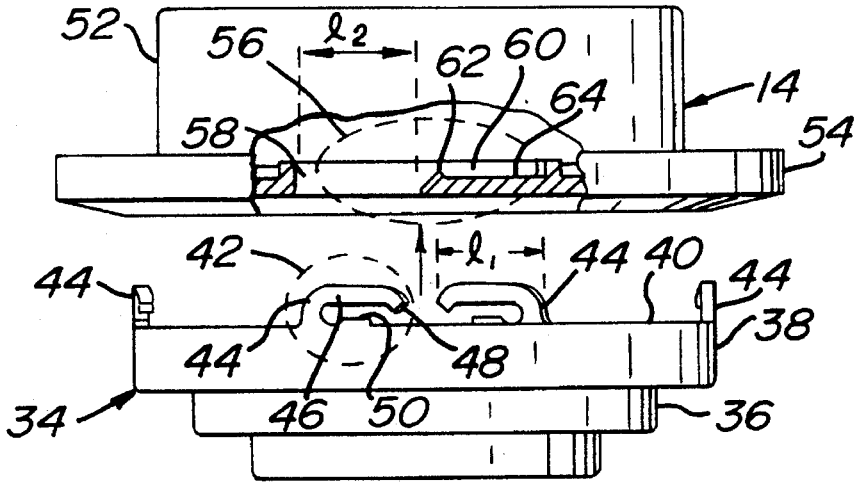
FIGS. 3, 4 and 5 illustrate an installation scheme for attaching trim to lamp housing in accordance with the present invention.
Figure 4:
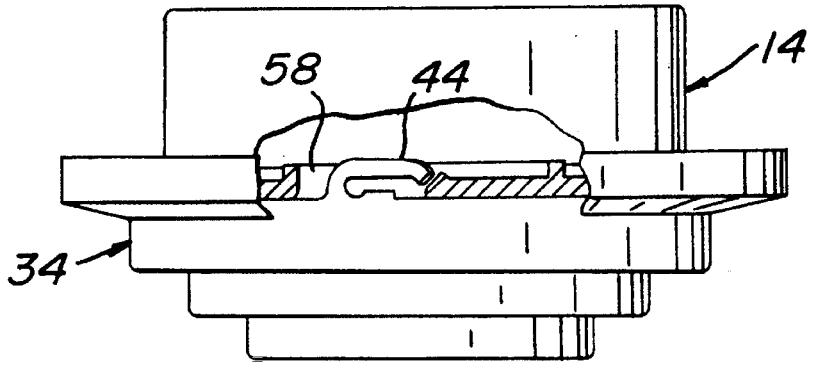
Figure 5:
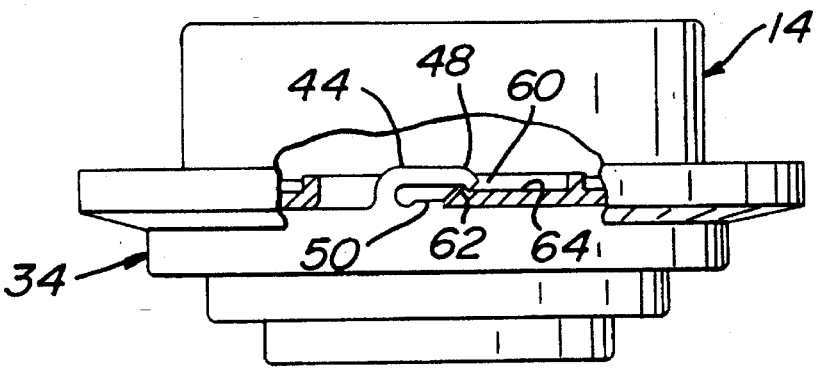

In FIGS. 3–5, a portion of the housing 14 is broken away to more clearly show how the attachment scheme of the present invention works. The attachment portions of trim 34 in FIGS. 3–5 are identical to the attachment portions of trim 12. However, the decorative portion of the trim 34 in FIGS. 3–5 is different than the decorative portion of trim 12. The trim 34 shows a decorative ring baffle design, instead of the eyelid design of trim 12. As noted above, the trim can have any decorative design as long as it includes the trim portion of the novel attachment scheme described below.

FIG. 3 shows the trim 34 before it is mounted to the housing 14. (The housing 14 is presumed to be already secured to a wall or ceiling, as shown in FIG. 2.) The trim 34 includes a lower decorative region 36 and an upper circumferential region 38 having upper edge 40. The upper edge 40 defines a plane. The region 38 includes one or more attachment regions 42 defined by the dashed circled area. A rigid and flexible tongue or finger 44 is provided on the upper edge 40 in each of the attachment regions 42. When more than one attachment region 42 is employed, they are spaced at even intervals along the upper edge 40. FIGS. 3–5 show four such attachment regions 42, each having a finger 44. The fingers 44 generally follow the contour of the upper circumferential region 38 of the trim 34.

Figure 6:
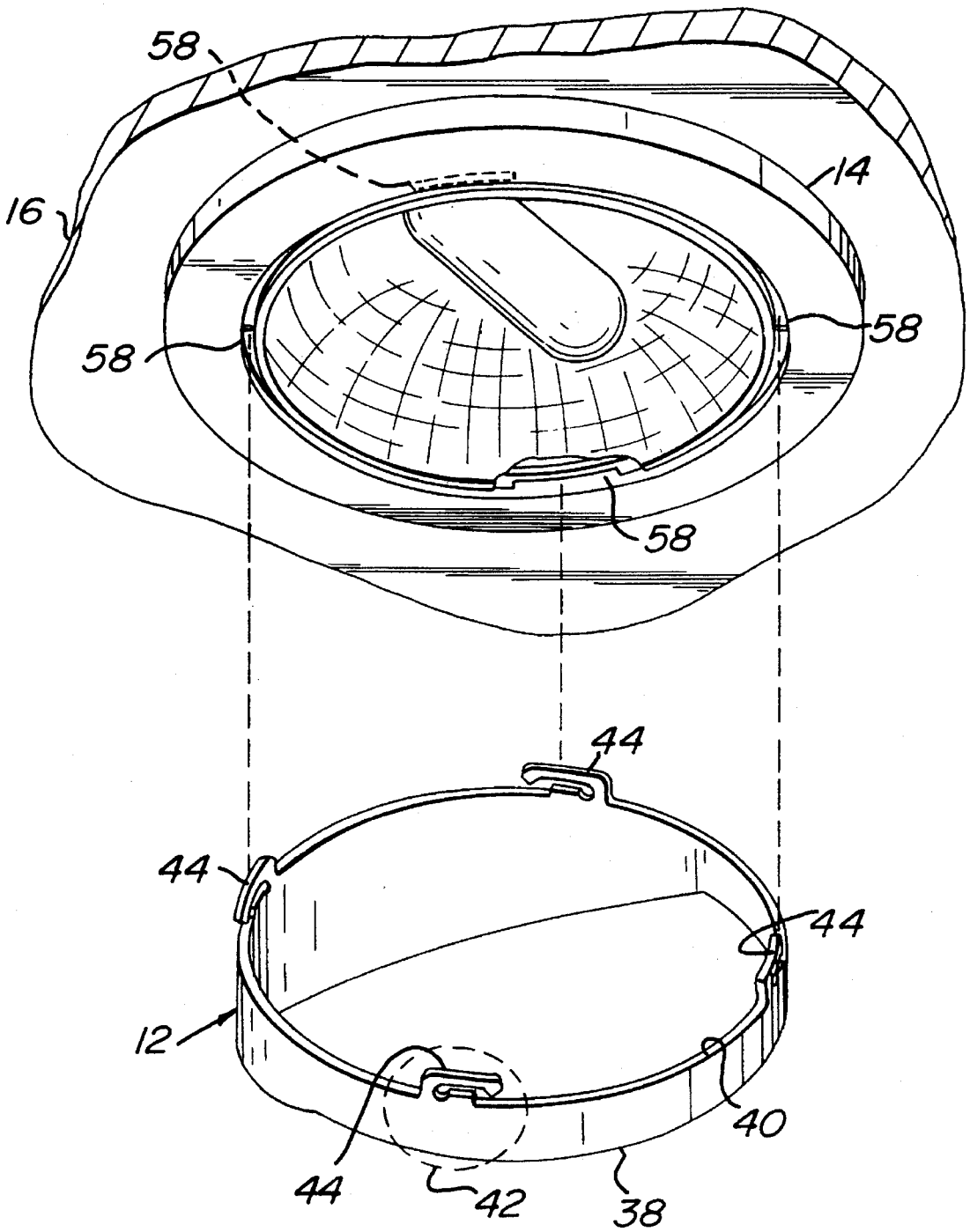
FIG. 6 is an exploded perspective view of trim and a recess mounted lamp housing.

FIG. 6 further illustrates the geometrical orientation of the trim piece attachment regions 42 and their associated fingers 44. As shown in FIG. 6, trim 12 includes four fingers 44 spaced at equal intervals around the upper edge 40 of the upper circumferential region 38.

Referring again to FIG. 3, each finger 44 includes a shaft 46 with a downwardly curved lip 48 at its free end. The other end of the shaft 46 connects to the upper edge 40 of the region 38. The finger 44 has a circumferential length of $l_1$.

A stop 50 is associated with each of the attachment regions 42. The stop 50 extends upward from the upper edge 40 of the trim 34. The stop 50 is positioned a short distance inward from the finger's lip 48. The stop 50 limits rotational movement of the trim 34 when it is attached to the housing 14, as described below with respect to FIG. 5.

The housing 14 includes a cylindrical housing portion 52 which is either fully or partially recessed into a wall or ceiling and a circular trim flange 54 extending therefrom. The flange 54 lies flush against the wall or ceiling 16 (not shown in FIG. 3, but visible in FIG. 6) when the housing portion 52 is fully recessed therein. The housing 14 also includes at least one attachment region 56 (defined by an dashed oval area) disposed along a lower edge or lower circumference of the housing portion 52. The attachment region 56 follows the contour of the housing portion's lower edge. The housing attachment region 56 mates with respective trim attachment regions 42. Although FIG. 3 shows only one housing attachment region 56, there are four such regions 56 in this embodiment, three of the regions 56 being hidden from view.

Each of the housing attachment regions 56 includes a slot 58 and an adjacent detent sector 60. The slot 58 is in communication with the detent sector 60. The slot 58 has a circumferential length of $l_2$ which is slightly larger than the circumferential length of $l_1$ of a finger 44. The detent sector 60 includes raised tab or tooth 62 and detent region 64. The tooth 62 is situated at one end of the detent region 64, adjacent to the slot 58. The tooth 30 is ramped on either side.

FIG. 3 shows an initial step for attaching the trim 34 to the housing 14. (As noted above, it is presumed that the housing 14 is already attached to the wall or ceiling.) Trim attachment region 42 is aligned with a housing attachment region 56. If more than one pair of attachment regions are employed, the other regions will automatically be aligned.

FIG. 4 shows an intermediate installation step. In this step, the trim 34 is moved towards the housing 14 until the finger 44 enters the housing slot 58.

The trim 34 is then rotated clockwise. As it is rotated, the finger 44 flexes slightly upward to allow the finger's lip 48 to travel over the ramped tooth 62. After the lip 48 travels over the tooth 62, it becomes seated into the housing detent region 64. At the same time, the trim's stop 50 hits the toothed end of the detent sector 60, thereby inhibiting further clockwise movement of the trim 34 with respect to the housing 14.

FIG. 5 shows the completed installation. When the trim 34 reaches the position shown in FIG. 5, it will remain held in position. The trim 34 is easily removable by simply reversing the installation process.

Turning again to FIG. 6, the housing 14 shows three slots 58 for accepting fingers 44. A fourth slot 58 is not visible in this view and thus is shown with phantom lines. Once the fingers 44 are received by the slots 58 and seated into the housing detent sectors (not shown), all of the parts of the trim and housing attachment regions become hidden from view. The resultant lighting unit thus has a cleaner appearance than other types of units where certain attachment parts are exposed.

The trim attachment regions 42 need not lie along the same cylindrical surface as the trim's upper edge 40. Instead, the regions 44 could extend upward from an inward or outward flange attached to the trim's upper edge 40. In such an embodiment, the regions 42 would be offset from the trim's upper edge 40 and would be associated with a circumferential region of the flange. It is only necessary that the trim and housing attachment regions 42 and 56 align with each other so that each of the fingers 44 align with a respective detent sector 60.

It should also be clear from the figures that a first imaginary circle can be drawn connecting each of the trim attachment regions 42 and a second imaginary circle can be drawn connecting each of the housing attachment regions 56. The two imaginary circles will have about the same radius and will be generally coaxial.

The trim attachment regions 42 could also be cut into the trim's upper circumferential region 38 with appropriate modifications made to the cylindrical housing portion 52 to allow the trim 34 to move further into the housing 14 before the trim 34 is rotated into its locked position. The trim and housing attachment regions 42 and 56 could also be arranged upside down (i.e., oriented 180 degrees) from the orientation shown in the figures.

The trim's stop 50 could also extend upward from the upper edge of the housing detent region 64. Alternatively, the length of the detent region 64 could be shortened from the length shown in the figures so that it inherently forms a stop at the appropriate location.

Although the figures show the novel attachment scheme employed to attach trim to a recess mounted housing, it should be understood that the invention is not limited to recessed housings and could also be employed to surface mount trim to housing. In a surface mounted embodiment, the cylindrical housing portion 52 (see FIG. 3) would not be completely recessed into the wall or ceiling. Instead, a lower portion of it would extend below the ceiling (or out from the wall).

Figure 7:
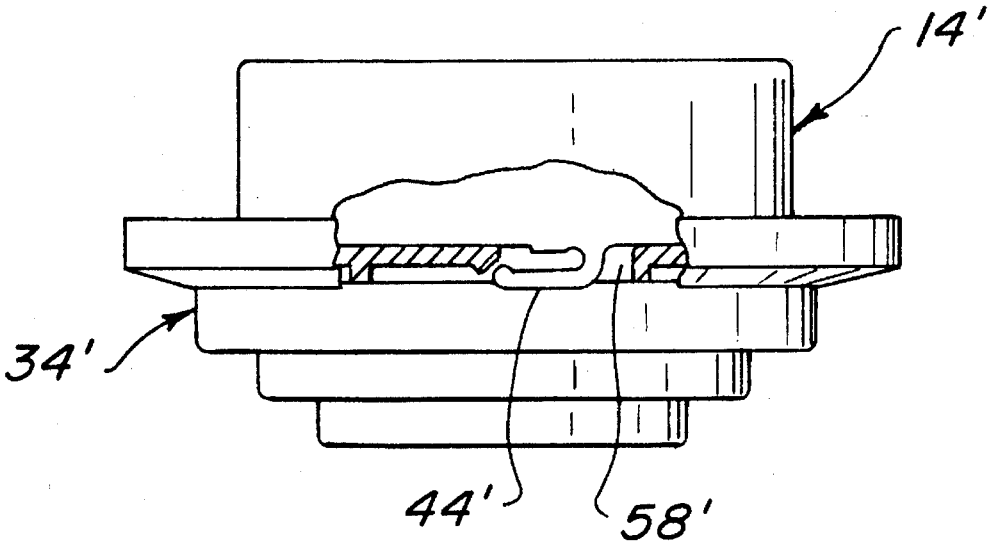
FIG. 7 is a sectional view similar to FIGS. 4 and 5, illustrating an alternate trim attachment scheme in accordance with the present invention.

The trim and housing attachment regions could be reversed so that fingers fixedly attached to a housing seat into a detent region of the trim. An example of this alternate attachment scheme is illustrated in FIG. 7. According to this alternate scheme, the housing 14' is essentially the same as housing 14, except that housing 14' has an attachment finger 44' instead of a slot 58. Likewise, trim 34' is essentially similar to trim 34, except that trim 34' has a slot 58' instead of a finger 44. As can be seen from FIG. 7, finger 44' is essentially the same in form and function as finger 44, and slot 58' is essentially the same in form and function to slot 58. Their locations are merely reversed with respect to the housing and trim. As with the attachment scheme described in connection with FIGS. 1 through 6, the trim piece 34' is easily attached to housing 14' by simply inserting it axially and then rotating it so that fingers 44' engage slots 58'.

The depicted embodiment of the novel attachment scheme discloses trim and housing having four mating attachment regions. Although the attachment scheme can be employed with only one pair of mating attachment region, a plurality of pairs of mating attachment regions are preferred to create a more secure attachment.

The novel attachment scheme described above can be adapted to attach any sort of lamp housing and trim having mating attachment regions. The novel scheme employs attachment parts which are built into the housing and trim, and thus does not require additional parts to join the trim to the housing. The novel scheme allows the trim to quickly connect and disconnect from the housing without any tools. In its fully assembled state, all of the attachment parts are completely hidden from view.

The present invention may be embodied in other specific forms without departing from the spirit or essential attributes thereof and, accordingly, reference should be made to the appended claims, rather than to the foregoing specification, as indicating the scope of the invention.

We claim:

1. A trim attachment system for a recessed lighting unit including a lamp housing having a generally cylindrical support and a trim piece having a generally cylindrical portion for attachment thereto, the system comprising at least one first attachment region associated with a first circumferential region on a selected one of said cylindrical support and/or trim piece and at least one second attachment region associated with a second circumferential region on the other one of said cylindrical support or trim piece for mating with the first attachment region, the first attachment region including a slot extending along the first circumferential region and having a first length, and a detent sector adjacent to and in communication with the slot and also extending along the first circumferential region, said detent sector includes a detent region and a tooth, the tooth being adjacent to the slot so that the lip of the finger travels over the tooth to reach the detent region, the second attachment region including a finger thereon, the finger having a second length smaller than the first length so as to allow the finger to pass through the slot, the finger having a proximal end connected to the selected one of said cylindrical support and/or trim piece and a distal end, the finger having a lip at its distal end for seating into the detent sector when the finger is passed through the slot and the trim piece is rotated relative to the housing.

2. A trim attachment system according to claim 1 wherein a selected one of the first or second attachment regions includes a stop to inhibit circumferential movement of the lip along the detent region after it travels over the tooth.

3. A trim attachment system according to claim 1 wherein the finger is rigid and flexible so as to allow the finger to slightly bend outward as the lip travels over the tooth and to return to its original position after the lip reaches the detent region.

4. A trim attachment system according to claim 1 wherein the tooth is ramped on either side to allow the lip to smoothly travel thereover.

5. A trim attachment system according to claim 1 wherein the first attachment region is associated with the housing and the second attachment region is associated with the trim piece.

6. A trim attachment system according to claim 5 wherein the housing has an outer circumferential portion surrounding the first attachment region which hides the first and second attachment regions from view.

7. A trim attachment system according to claim 1 wherein the second attachment region is disposed near an edge of the selected one of the trim piece or housing.

8. A trim attachment system according to claim 7 wherein the edge associated with the second attachment region is generally planar, the finger extending outward from the edge and generally following the edge's contour.

9. A trim attachment system according to claim 1 wherein the system includes a plurality of first and second attachment regions.

10. A trim attachment system according to claim 9 wherein the first and second attachment regions are arranged so that a first imaginary circle can connect each of the first attachment regions and a second imaginary circle can connect each of the second attachment regions, the two imaginary circles being generally coaxial and having about the same radius.

11. A trim attachment system for a recessed lighting unit comprising:

(a) a lamp housing for attachment to a structural support, the housing having a generally cylindrical portion of preselected circumference, the housing having a plurality of first attachment regions spaced along the circumference of its cylindrical portion, each of the first attachment regions including (i) a slot extending along the circumference and having a first length, and (ii) a detent sector adjacent to and in communication with the slot, the detent sector extending along the circumference; and (b) a trim piece for attachment to the housing, the trim piece having an upper circumferential region and including a plurality of second attachment regions, each of the second attachment regions associated with a respective one of the first attachment regions and including (i) a finger extending from the upper circumferential region and generally following the contour of the upper circumferential region, the finger having a second length smaller than the first length so as to allow the finger to pass through the slot, the finger having a proximal end connected to the trim piece and a distal end, and (ii) a lip at the distal end of the finger for seating into the detent sector when the finger is passed through the slot and the trim piece is rotated relative to the housing.

12. A trim attachment system according to claim 11 wherein the detent sector includes a detent region and a tooth, the tooth being adjacent to the slot so that the lip of the finger travels over the tooth to reach the detent region.

13. A trim attachment system according to claim 12 wherein the second attachment region includes a stop to inhibit circumferential movement of the lip along the detent region after it travels over the tooth.

14. A trim attachment system according to claim 12 wherein the finger is rigid and flexible so as to allow the finger to slightly bend outward as the lip travels over the tooth and to return to its original position after the lip reaches the detent region.

15. A trim attachment system according to claim 12 wherein the tooth is ramped on either side to allow the lip to smoothly travel thereover.

16. A trim attachment system according to claim 11 wherein the first attachment regions are disposed near a lower edge of the housing.

17. A trim attachment system according to claim 11 wherein the upper circumferential region of the trim piece has a generally planar upper edge, the fingers extending from the edge and generally following the edge's contour.

18. A trim attachment system according to claim 11 wherein the housing has an outer circumferential trim portion surrounding the first attachment region which hide the first and second attachment regions of a fully assembled lighting unit from view.

19. A trim attachment system according to claim 11 wherein the first and second attachment regions are arranged so that a first imaginary circle can connect each of the first attachment regions and a second imaginary circle can connect each of the second attachment regions, the two imaginary circles being generally coaxial and having about the same radius.

* * * * *